US008733464B2

(12) United States Patent
Chattaway et al.

(10) Patent No.: US 8,733,464 B2
(45) Date of Patent: May 27, 2014

(54) COMBINED FIRE EXTINGUISHING SYSTEM

(75) Inventors: Adam Chattaway, Windsor (GB); Robert G. Dunster, Slough (GB)

(73) Assignee: Kidde Technologies, Inc., Wilson, NC (US)

( * ) Notice: Subject to any disclaimer, the term of this patent is extended or adjusted under 35 U.S.C. 154(b) by 373 days.

(21) Appl. No.: 13/015,663

(22) Filed: Jan. 28, 2011

(65) Prior Publication Data

US 2012/0145416 A1 Jun. 14, 2012

(30) Foreign Application Priority Data

Dec. 9, 2010 (GB) ..... 1020955.9

(51) Int. Cl.

| | |
|---|---|
| ***A62C 3/07*** | (2006.01) |
| ***A62C 37/36*** | (2006.01) |
| ***A62C 37/44*** | (2006.01) |
| ***A62C 35/11*** | (2006.01) |

(52) U.S. Cl.

USPC ..... 169/62; 169/16; 169/60; 169/61

(58) Field of Classification Search

USPC ..... 169/16, 43, 54, 56, 60–62

See application file for complete search history.

(56) References Cited

U.S. PATENT DOCUMENTS

| | | | | |
|---|---|---|---|---|
| 2,353,765 | A * | 7/1944 | Mathisen | 169/61 |
| 2,563,837 | A | 8/1951 | Grant, Jr. | |
| 3,876,011 | A * | 4/1975 | Poitras | 169/57 |
| 4,082,148 | A | 4/1978 | Willms | |
| 4,305,469 | A | 12/1981 | Morrisette | |
| 4,351,394 | A | 9/1982 | Enk | |
| 4,520,871 | A | 6/1985 | Miller et al. | |
| 4,688,183 | A | 8/1987 | Carll et al. | |
| 4,715,448 | A * | 12/1987 | McCulloch | 169/62 |
| 4,909,329 | A | 3/1990 | Yoshida et al. | |
| 4,971,109 | A | 11/1990 | McHugh | |
| 5,613,564 | A * | 3/1997 | Rhines | 169/61 |
| 5,622,438 | A | 4/1997 | Walsh et al. | |
| 5,673,755 | A | 10/1997 | Sundholm | |
| 5,786,285 | A | 7/1998 | Walla et al. | |
| 5,908,528 | A | 6/1999 | Walla et al. | |
| 5,912,195 | A | 6/1999 | Walla et al. | |
| 6,396,404 | B1 | 5/2002 | McHugh | |
| 6,896,067 | B2 | 5/2005 | Bowyer et al. | |
| 2005/0139366 | A1 | 6/2005 | Scheidt | |

(Continued)

FOREIGN PATENT DOCUMENTS

| | | |
|---|---|---|
| CN | 101022854 | 8/2007 |
| DE | 29709414 | 9/1997 |

(Continued)

OTHER PUBLICATIONS

Combined Search and Examination Report, dated Apr. 6, 2011, Application No. GB1020955.9.

(Continued)

*Primary Examiner* — Darren W Gorman

(74) *Attorney, Agent, or Firm* — Carlson, Gaskey & Olds, P.C.

(57) ABSTRACT

A fire suppression system includes a divert valve downstream of a fire suppressant source. The divert valve is selectively movable between an initial first position which communicates extinguishing agent into a first distribution network and a second position which communicates extinguishing agent into a second distribution network.

16 Claims, 5 Drawing Sheets

(56) References Cited

U.S. PATENT DOCUMENTS

| | | | |
|---|---|---|---|
| 2006/0016608 | A1 | 1/2006 | Simpson et al. |
| 2007/0034387 | A1 | 2/2007 | Andersen et al. |
| 2010/0038101 | A1 | 2/2010 | Terry et al. |
| 2010/0236796 | A1 | 9/2010 | Chattaway et al. |

FOREIGN PATENT DOCUMENTS

| | | |
|---|---|---|
| EP | 1234600 | 8/2002 |
| FR | 2919506 | 2/2009 |
| GB | 544262 | 4/1942 |
| GB | 2045611 | 11/1980 |
| GB | 2305121 | 4/1997 |
| WO | 8101796 | 7/1981 |
| WO | 8600969 | 7/1985 |

OTHER PUBLICATIONS

Singapore Search Report. Application No. 201109125-3. Sep. 14, 2012.

European Search Report for European Patent Application No. 11190817.4-1659 completed on Mar. 20, 2013.

* cited by examiner

COMBINED FIRE EXTINGUISHING SYSTEM

REFERENCE TO RELATED APPLICATIONS

This application claims the benefit of United Kingdom Patent Application No. 1020955.9, filed Dec. 9, 2010.

BACKGROUND

The present disclosure relates to a fire suppression system and more particularly to a divert valve therefor.

With the changing roles of military vehicles, the distinction between fighting vehicles and tactical vehicles is now blurred or non-existent. Tactical vehicles are now being up-armored and fitted with fire protection systems. As tactical vehicles are relatively smaller and lighter vehicles, relatively smaller and lighter fire protection systems are desired.

SUMMARY

A fire suppression system according to an exemplary aspect of the present disclosure includes a divert valve downstream of a fire suppressant source. The divert valve is selectively movable between a first position and a second position, the divert valve initially positioned in the first position. A first distribution network is in communication with the divert valve, the first position orienting the divert valve so that the fire suppressant source is in communication with the first distribution network. A second distribution network in communication with the divert valve, the second position orienting the divert valve so that the fire suppressant source is in communication with the second distribution network.

A method of actuating a fire suppression system according to an exemplary aspect of the present disclosure includes orienting a divert valve to either of a first position or a second position and releasing an extinguishing agent from a fire suppressant source into the divert valve to communicate the extinguishing agent into a first vehicle zone associated with the first position or a second vehicle zone associated with the second position.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
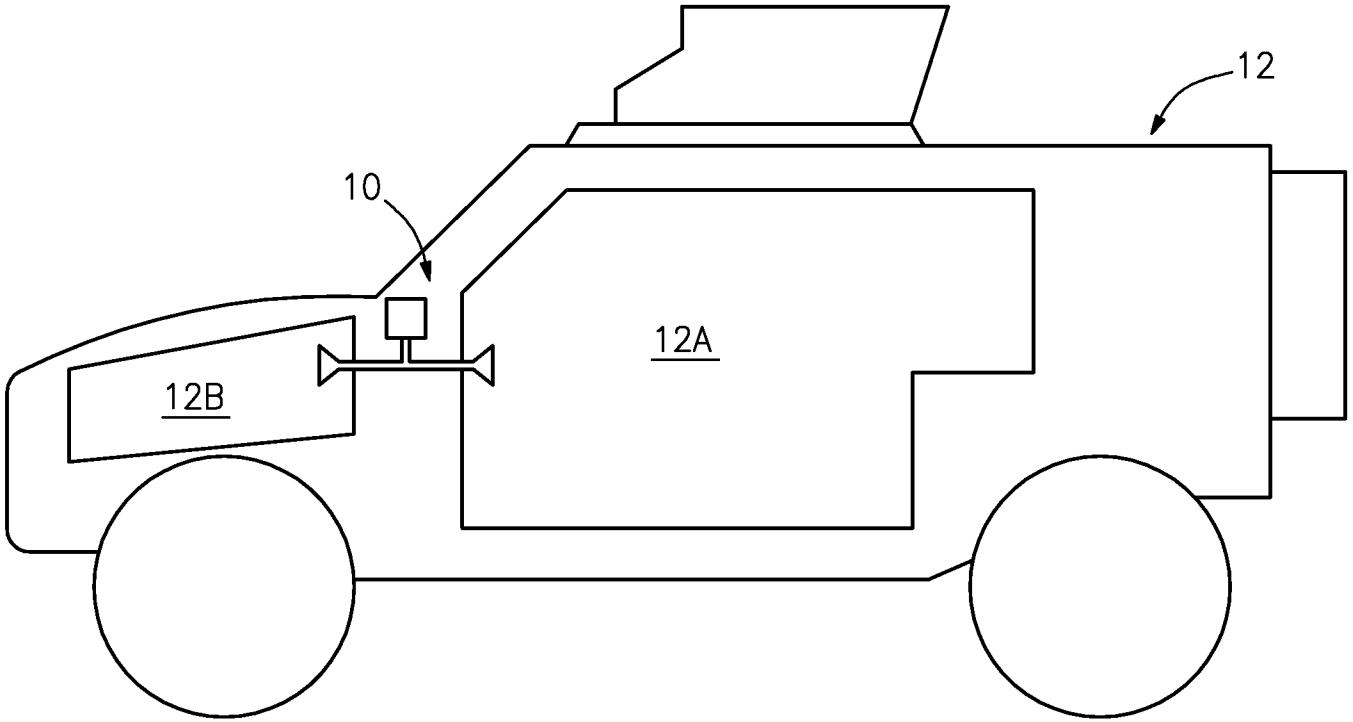
FIG. 1 is a schematic view of a vehicle with a fire suppression system according to one non-limiting embodiment of the present disclosure.

FIG. 1 schematically illustrates selected portions of an example fire suppression system 10 that may be used to control a fire threat. The fire suppression system 10 may be utilized within a ground vehicle 12 such as a tactical wheeled vehicle; however, it is to be understood that the exemplary fire suppression system 10 may alternatively be utilized in other land, sea and air vehicles.

The fire suppression system 10 is implemented within the vehicle 12 to control any fire threats that may occur in vehicle zones 12A and 12B. For instance, zone 12A may be a high hazard area such as a crew compartment and zone 12B may be a relatively lower hazard area such as an engine compartment. The high hazard area requires rapid extinguishment to protect the crew while the relatively lower hazard area requires a relatively slower extinguishment time. It should be understood that other zones such as cargo bays, wheel wells, electronics bays, ammunition storage and others where fire suppression is desired and may be considered to be different hazard levels may additionally be so segregated.

Figure 2:
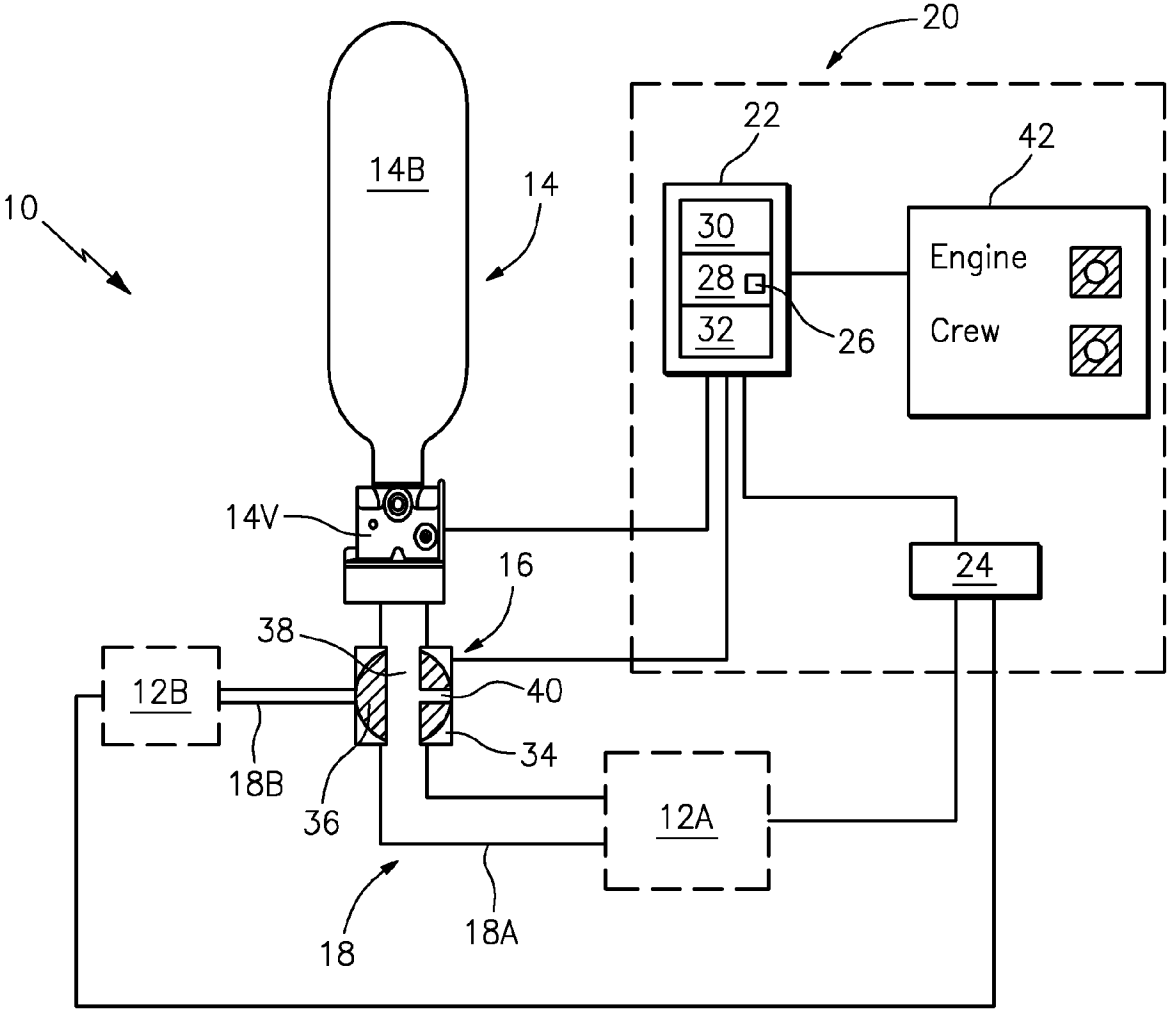
FIG. 2 is a block diagram of an exemplary fire suppression system.

With reference to FIG. 2, the fire suppression system 10 generally includes a fire suppressant source 14, a distributor valve 16, a distribution system 18 and a control system 20. The fire suppressant source 14 in the disclosed non-limiting embodiment is a pressurized bottle 14B that contains an extinguishing agent appropriate for use in, for example only, both an engine compartment and a crew compartment.

For relatively smaller vehicles, a single bottle fire suppressant source 14 can protect either of vehicle zones 12A and 12B which saves space, weight and simplifies logistics. In one non-limiting embodiment, the fire suppressant source 14 is located in the crew compartment 12A, with the extinguishing agent selectively diverted into the engine compartment 12B through the distribution system 18. The extinguishing agent concentration is calculated for the primary vehicle zone 12A as these limits cannot be exceeded due to the potential detrimental to crew survivability. Usually the secondary vehicle zone 12B such as the engine compartment is smaller but unoccupied so this would result in higher, yet still safe, agent concentrations. However if more agent is required then a second separate bottle fire suppressant source 14 may be required.

The divert valve 16 provides for selective communication of the extinguishing agent from the fire suppressant source 14 into a distribution network 18A, 18B (illustrated schematically) of the distribution system 18 associated with the respective vehicle zones 12A, 12B in response to the control system 20. The control system 20 generally includes a module 22 and a sensor system 24. The module 22 typically includes a processor 28, a memory 30, and an interface 32. The processor 28 may be any type of microprocessor having desired performance characteristics. The memory 30 may include any type of computer readable medium which stores the data and control algorithms described herein. The interface 32 may include any system that facilitates communication with the sensor system 24 as well as other systems. The sensor system 24 may include, for example, infrared optical sensors strategically placed throughout the vehicle which sense and identify open flames and hydrocarbon signatures from non-threatening sources.

The divert valve 16 generally includes a housing 34 and a valve 36 such as a rotary valve with a first passage 38 and a second passage 40. It should be understood that various valves other than a rotary valve, such as, for example only, a linear slide/shuttle valve, may alternatively be utilized. In one non-limiting embodiment, the first passage 38 passes through the rotary valve 36 and the second passage 40 intersects with the first passage 38. It should be understood that various passage arrangements may alternatively or additionally be provided.

Figure 3:
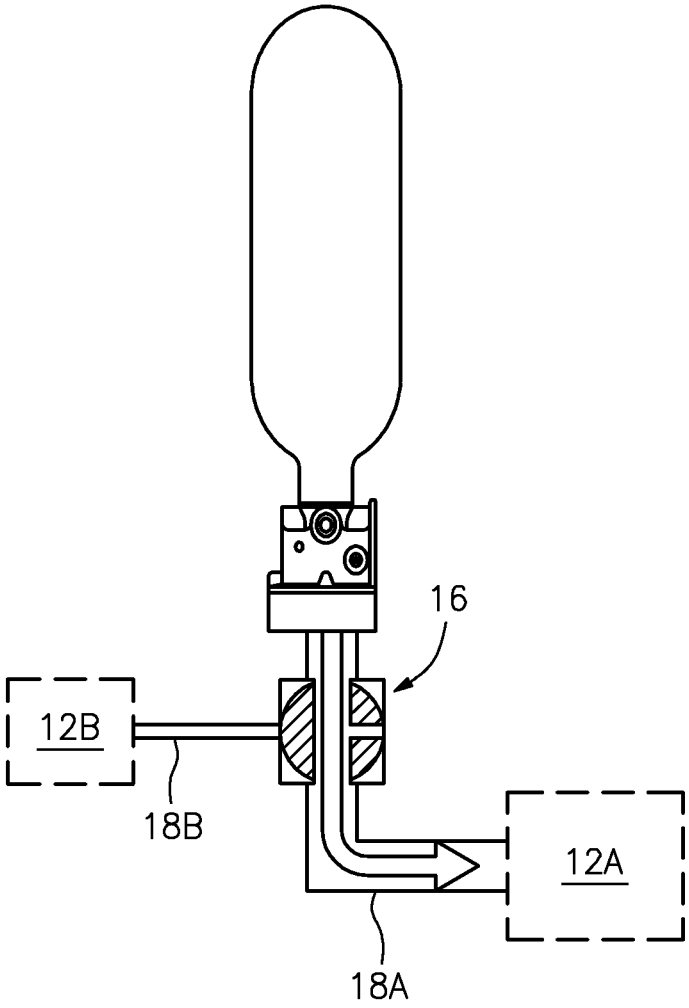
FIG. 3 is a block diagram of the fire suppression system in a first position.
Figure 4:
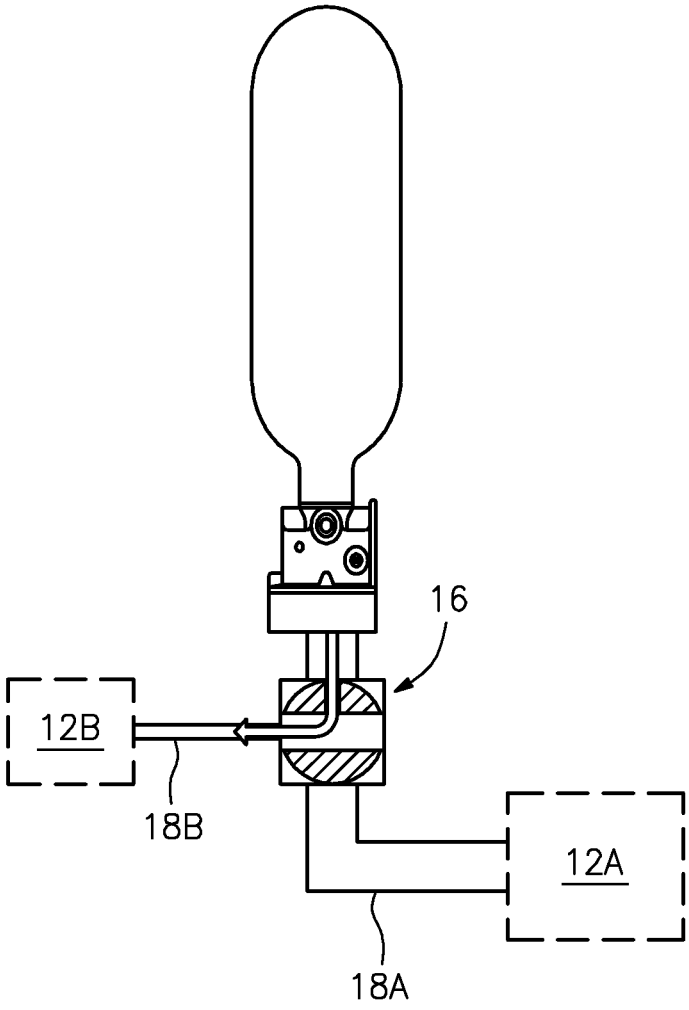
FIG. 4 is a block diagram of the fire suppression system in a second position.

The valve 36 is movable between a first position (FIG. 3) and a second position (FIG. 4). The first position is a preset initial position which orients the first passage 38 into communication with the fire suppressant source 14 to distribute the extinguishing agent into the distribution network 18A and into vehicle zone 12A. That is, the valve 36 is normally positioned for communication with the crew compartment zone 12A to provide for fast detection and essentially immediate distribution of the extinguishing agent from the fire suppressant source 14. The second position orients the second passage 40 in communication with the fire suppressant source 14 to distribute the extinguishing agent from the second passage 40 into the first passage 38 then into the distribution network 18B and vehicle zone 12B.

The first passage 38 and the second passage 40 may be sized in relation to the vehicle zone 12A, 12B. That is, since the first passage 40 communicates with the vehicle zone 12A which is usually the relatively larger crew compartment and requires more immediate action, the first passage 40 is relatively larger to provide a greater mass flow of extinguishing agent than the second passage 40. It should be understood that the respective sizes of the first passage 38 and the second passage 40 provide a desired mass flow over a desired time period in relation to the vehicle zone 12A, 12B. For example, a relatively significant amount of extinguishing agent may be communicated to the crew compartment over a relatively short time period as compared to the engine compartment which may require a relatively smaller mass flow of extinguishing agent over a relatively longer time period.

The divert valve 16 is mounted immediately downstream of an actuator valve 14V of the fire suppressant source 14 which selectively releases the extinguishing agent into the divert valve 16. The actuator valve 14V is a main valve such as a flapper, cartridge, or solenoid actuated valve mounted to the fire suppressant source 14 or integrated therewith to release the extinguishing agent. That is, the actuator valve 14V is mounted to the divert valve 16 and is operable to release the agent from the fire suppressant source 14 in, for example, a one-shot arrangement while the divert valve 16 controls which of the respective distribution networks 18A, 18B receives the extinguishing agent so as to efficiently utilize the extinguishing agent. It should be understood that two or more fire suppressant sources 14 may be fitted to a single actuator valve 14V to provide a two or more shot (crew), two or more shot (engine) or one shot (crew) and one shot (engine) arrangement through the divert valve 16.

Figure 5:
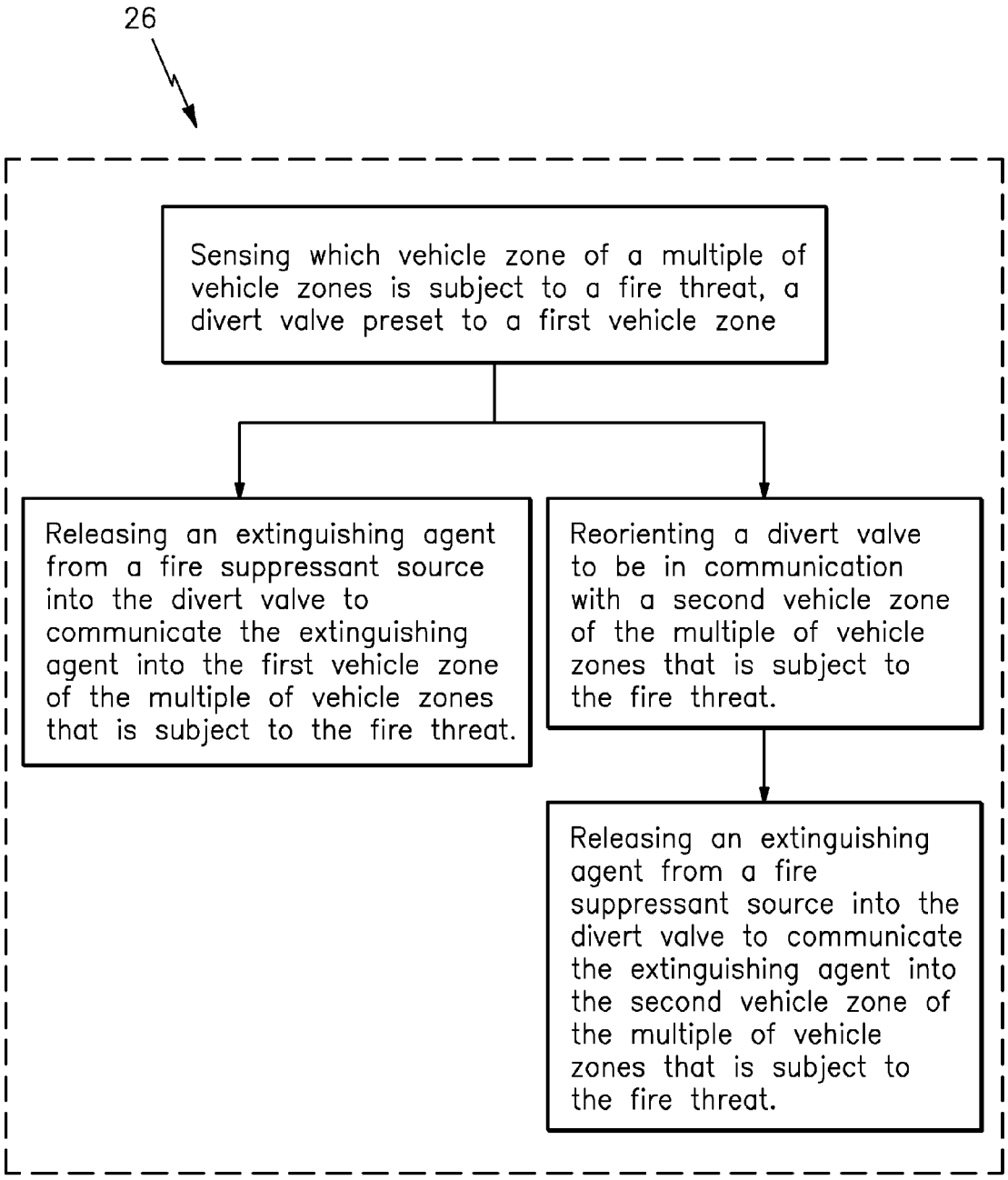
FIG. 5 is a flowchart illustrating operation of the fire suppression system.

The module 22 executes an algorithm 26 to control which vehicle zone 12A, 12B receives the extinguishing agent from the fire suppressant source 14 in response to the sensor system 24. The functions of the algorithm 26 are disclosed in terms of functional block diagrams in FIG. 5, and it should be understood by those skilled in the art with the benefit of this disclosure that these functions may be enacted in either dedicated hardware circuitry or programmed software routines capable of execution in a microprocessor based electronics control embodiment. When implemented as programmed software routines, the functions of algorithm 26 may be tangibly embodied in memory 30 for execution by processor 28.

In operation, the sensor system 24 detects a fire threat within the vehicle zone 12A, 12B then the module 22 orients the divert valve 16 to the appropriate position if need be. That is, as the divert valve 16 is normally positioned or preset for communication of the extinguishing agent to the crew compartment vehicle zone 12A, if the sensor system 24 detects a fire threat within the vehicle zone 12A, activation is immediate as the module need only open the actuator valve 14V to selectively release the extinguishing agent through the divert valve 16 and the distribution network 18A into the associated vehicle zone 12A. Only if the fire threat is detected as within zone 12B, need the module 22 first reorient the divert valve 16 to the zone 12B position then open the actuator valve 14V of the fire suppressant source 14 to release the extinguishing agent into the divert valve 16 to divert the extinguishing agent into the distribution network 18B and the associated vehicle zone 12B.

Alternately, a user may manually select the vehicle zone 12A, 12B into which the extinguishing agent is to be released on a user interface 42 and the module 22 responds accordingly. That is, the module 22 reorients the divert valve 16 to the appropriate position if need be then opens the actuator valve 14V of the fire suppressant source 14 to release the extinguishing agent into the divert valve 16 which diverts the extinguishing agent into the appropriate distribution network 18A, 18B and the selected vehicle zone 12A, 12B.

It should be understood that the fire suppression system 10 may be combined with other dedicated crew or engine compartment fire suppressant systems as well as multi-shot fire suppressant sources. Such alternative arrangements facilitate specific application to different relative volumes of the vehicle zones 12A, 12B. A fast, automatic system that discharges in, for example, less than 250 msec is provided for the higher priority zone and a slightly slower response for lesser priority zone that may discharge over several seconds with a minimum of components is thereby provided.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A fire suppression system comprising:

a fire suppressant source;

a divert valve downstream of said fire suppressant source, said divert valve including therein a first passage and a second passage, said divert valve selectively movable between a first position and a second position;

a first distribution network in communication with said divert valve, said first position orients said divert valve so that said fire suppressant source is in communication with said first distribution network through said first passage; and a second distribution network in communication with said divert valve, said second position orients said divert valve so that said fire suppressant source is in communication with said second distribution network through said second passage, wherein said first passage and said second passage are differently sized such that said first passage is operable to provide a greater mass flow than said second passage.

2. The fire suppression system as recited in claim 1, wherein said second passage intersects with said first passage.

3. The fire suppression system as recited in claim 1, wherein said divert valve is a rotary valve rotatable between said first position and said second position.

4. The fire suppression system as recited in claim 1, further comprising an actuator valve, said divert valve is downstream of said actuator valve.

5. The fire suppression system as recited in claim 4, wherein said actuator valve is operable to selectively release an extinguishing agent from said fire suppressant source into said divert valve.

6. The fire suppression system as recited in claim 5, further comprising a control system operable to position said divert valve and actuate said actuator valve to selectively release said extinguishing agent from said fire suppressant source into said divert valve.

7. The fire suppression system as recited in claim 6, wherein said control system is operable to position said divert valve prior to actuation of said actuator valve.

8. The fire suppression system as recited in claim 3, wherein said second passage intersects with an intermediate portion of said first passage.

9. The fire suppression system of claim 7, wherein said control system includes a sensor system operable to detect a fire threat within at least one of a first vehicle zone and a second vehicle zone, said first vehicle zone associated with said first distribution network and said second vehicle zone associated with said second distribution network.

10. The fire suppression system of claim 9, wherein said control system further includes a module, said module operable to orient said divert valve to said first position if said sensor system detects a fire threat in said first vehicle zone or to said second position if said sensor system detects a fire threat in said second vehicle zone.

11. The fire suppression system of claim 9, wherein said divert valve is initially positioned in said first position, wherein said control system further includes a module, said module operable to orient said divert valve to said second position if said sensor system detects a fire threat in said second hazard area.

12. The fire suppression system of claim 11, wherein said first hazard area is a crew compartment zone.

13. The fire suppression system of claim 7, wherein said divert valve is a rotary valve, wherein said second passage intersects said first passage, and wherein when said divert valve is in said second position, said divert valve is oriented such that said extinguishing agent enters said divert valve through said second passage and exits said divert valve through said first passage.

14. The fire suppression system of claim 2, wherein said second position orients said divert valve so that said fire suppression source is in communication with said second distribution network through said second passage and said first passage.

15. The fire suppression system of claim 1, wherein said first passage and said second passage are differently sized with respect to passage width.

16. The fire suppression system of claim 1, wherein said first distribution network is in communication with a crew compartment zone and said second distribution network is in communication with an engine compartment zone, and said divert valve is initially positioned in said first position, wherein said first passage is larger than said second passage.

* * * * *